US005238115A

United States Patent [19]

Schäfer

[11] Patent Number: 5,238,115

[45] Date of Patent: Aug. 24, 1993

[54] STACKABLE TRANSPORTATION CONTAINER OF SHEET METAL

[75] Inventor: Gerhard Schäfer, Neunkirchen-Salchendorf, Fed. Rep. of Germany

[73] Assignee: Fritz Schäfer Gesellschaft mit beschränkter Haftung, Neunkirchen, Fed. Rep. of Germany

[21] Appl. No.: 776,555

[22] Filed: Oct. 15, 1991

[30] Foreign Application Priority Data

Nov. 7, 1990 [DE] Fed. Rep. of Germany ... 9015301[U]

[51] Int. Cl.[5] ..... B65D 21/02

[52] U.S. Cl. ..... 206/503; 220/558; 220/331; 220/335; 220/7

[58] Field of Search ..... 206/503, 509; 220/692, 220/558, 331, 335, 4.27, 7, 6, 4.29, 4.31, 4.32, 4.33, 756, 766

[56] References Cited

U.S. PATENT DOCUMENTS

| | | | |
|---|---|---|---|
| 1,336,972 | 4/1920 | Levene | 220/331 |
| 1,348,085 | 7/1920 | Cathcart | 220/558 |
| 1,732,437 | 10/1929 | Ganzer | 220/756 |
| 1,892,020 | 12/1932 | Straubel | 220/558 |
| 2,579,655 | 12/1951 | Donald | 220/331 |
| 2,840,083 | 6/1958 | Myers | 220/331 |
| 3,422,988 | 1/1969 | LaFranca | 220/331 |
| 3,854,544 | 12/1974 | Kolchev | 220/6 |
| 3,970,209 | 7/1976 | Baxter | 220/6 |
| 4,512,477 | 4/1985 | Densen | 220/4.29 |
| 4,643,306 | 2/1987 | Ryan | 206/503 |
| 4,715,508 | 12/1987 | Schurch | 220/7 |
| 4,735,330 | 4/1988 | Hoss | 220/7 |
| 4,775,072 | 10/1988 | Lundblade et al. | 220/766 |
| 4,917,255 | 4/1990 | Foy et al. | 220/6 |
| 5,028,740 | 7/1991 | Tomiya | 220/692 |
| 5,071,023 | 12/1991 | Perrot | 220/335 |

FOREIGN PATENT DOCUMENTS

| | | | |
|---|---|---|---|
| 1227059 | 8/1960 | France | 220/6 |
| 638655 | 6/1950 | United Kingdom | 220/692 |
| 1010726 | 11/1965 | United Kingdom | 220/6 |

*Primary Examiner*—Allan N. Shoap
*Assistant Examiner*—S. Castellano
*Attorney, Agent, or Firm*—Anderson Kill Olick & Oshinsky

[57] ABSTRACT

A stackable transportation container of sheet metal has two side walls and a rear wall. The container further has a front wall which is lower than the side walls and the rear wall. A flap is mounted above the upper edge of the front wall. The bearing members on the flap are formed by integrally manufactured loops, while the bearing members on the container are formed by two pins which are directed toward each other. Each of the pins is mounted on a support plate connected to a corner of the container. At least one of the support plates supporting a pin is separately attachable to the corner of the container, for example, by riveting.

3 Claims, 4 Drawing Sheets

STACKABLE TRANSPORTATION CONTAINER OF SHEET METAL

BACKGROUND OF THE INVENTION

1. Field of the Invention

The present invention relates to a stackable transportation container or box of sheet metal. The container has two side walls and a rear wall which have upper stacking edges forming the opening of the container. The container further has a front wall which is lower as compared to the side walls and the rear wall. A flap is mounted in the area of the upper edge of the front wall. The bearing members on the flap are formed by integrally manufactured loops, while the bearing members on the container are formed by two pins which are directed towards each other. Each of the pins is mounted on a support plate connected to a corner of the container.

SUMMARY OF THE INVENTION

In accordance with present invention, in a stackable transportation container of the above-described type, at least one of the support plates supporting a pin can be fastened subsequently to the corner of the container, for example, by riveting.

The advantage provided as a result of the above-described feature of the present invention is the fact that it is now possible to galvanize or provide with a similar surface coating the container, on the one hand, and the flap, on the other hand, independently of each other. The flap and the container are only subsequently connected to each other.

As a result, any possible distortion or bending of the flap during surface coating is effectively prevented.

In accordance with a further feature of the present invention, the support plate and the side wall on which the support plate is mounted each has at least two holes which can be placed so as to coincide in order to receive the connecting rivets. The support plate is provided with an approximately Z-shaped portion which engages in a supporting manner in front of the front wall.

In accordance with another advantageous feature, the loops forming the bearing members on the flap have in a direction parallel to the plane of the flap an oblong cross-section, wherein the internal length thereof corresponds at least to twice the internal width thereof, and wherein the loops in the closed position of the flap engage as a support stop in front of the upper edge of the front wall.

In accordance with another feature, the flap can be further stabilized by loops which have an uninterrupted oblong tubular profile extending along the entire width of the flap.

In addition, tongues which are bent rearwardly from the plane of the flap can be provided near the transverse edges of the flap. The side walls have above the front wall lugs which are bent toward each other. In the closed position of the flap, the tongues of the flap can be inserted in the lugs for a locked engagement.

In accordance with another important feature of the present invention, the stackable transportation container has a drop grip at the outside of the front wall and/or the rear wall. In addition, at least one transversely extending support rod can be arranged between the side walls and near the stacking edge.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figures 1, 2:
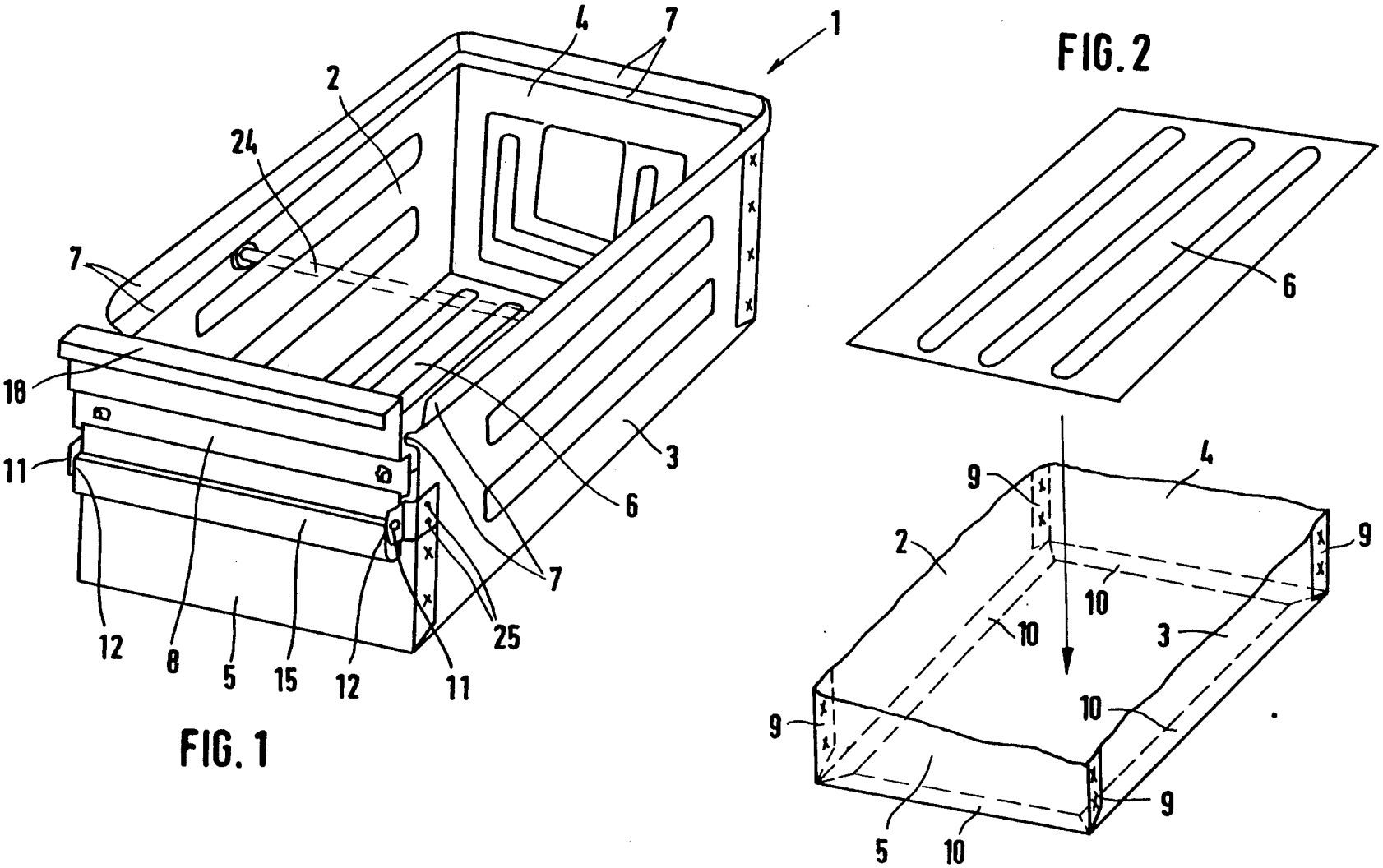
FIG. 1 is a perspective view of a stackable transportation container according to the present invention.
FIG. 2 is an exploded perspective view of the side walls, the rear wall and the front wall of the container of FIG. 1 before the bottom is mounted.

The stackable transportation container 1 shown in FIG. 1 is made of sheet metal and has two essentially symmetrically arranged side walls 2 and 3, a rear wall 4, a front wall 5 and a bottom 6. The stackable transportation container 1 has a stacking edge 7 extending along the two side walls 2 and 3 and along the rear wall 4. The stacking edge 7 essentially forms the container opening towards the top.

The two side walls 2 and 3 and the rear wall 4 have the same structural height in order to form the stacking edge 7. The front wall 5, on the other hand, has a lower structural height. For example, the structural height of the front wall 5 is at least half the structural height of the adjacent side walls 2 and 3. A flap 8 is mounted above the front wall 5, so that the container 1 can either be closed or provided with an opening for inspection and/or removal of objects from the container. The flap 8, as well as the side walls 2 and 3, the rear wall 4 and the front wall 5 are constructed as shaped sheet metal parts.

As can be seen in FIG. 2, the side walls 2 and 3 and the rear wall 4 as well as the front wall 5 can each be constructed of separate sheet metal blanks which can be rigidly connected to each other by spot welding in the region of outwardly bent, upright border strips 9 which, for example, are integrally connected to the rear wall 4 and the front wall 5. Similar border strips 10 can also be bent horizontally from the two side walls 2 and 3 and from the rear wall 4 and the front wall 5, and the bottom 6 can be placed from the top onto the border strips 10 and can be butt-welded thereto.

The flap 8 is mounted in the region of the upper edge of the front wall 5. For this purpose, two bearing members 11 on the container interact with two bearing members 12 on the flap.

Figure 3:
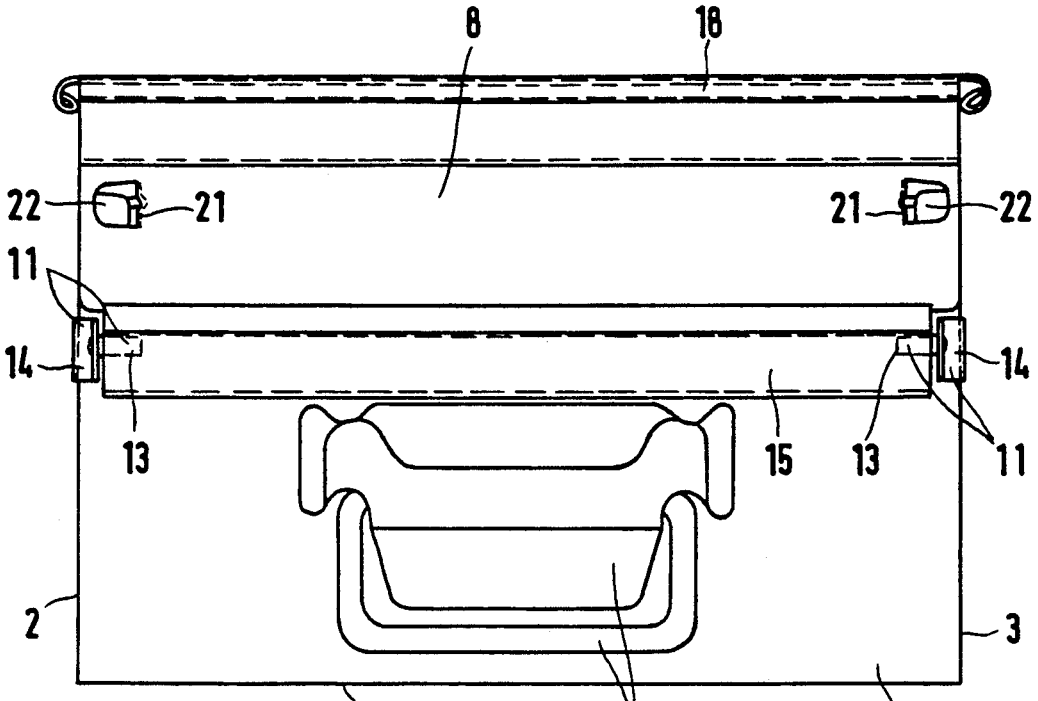
FIG. 3 is a front view of the container of FIG. 1 with a grip mounted on the front wall below the flap.

As can be seen particularly clearly in FIG. 3, the bearing members 11 on the container are each formed by a support plate 14 which supports a pin 13. The support plates 14 are fastened in the region of the container corners adjacent the front wall 5 in such a way that the free ends of the pin 13 are directed toward each other, as also clearly shown in FIG. 3. The axes of the two pins 13 are in alignment with each other and are located approximately on the level of the upper edge of the front wall 5.

The bearing members 12 on the container are constructed as loops 15, as particularly clearly shown in FIGS. 1, 4, 6 and 7. In a direction parallel to the plane of the flap 8, the loops 15 have an oblong cross-section, wherein the internal length 16 thereof corresponds at least to twice the internal width 17 thereof, as is clear from FIG. 6.

Figure 5:
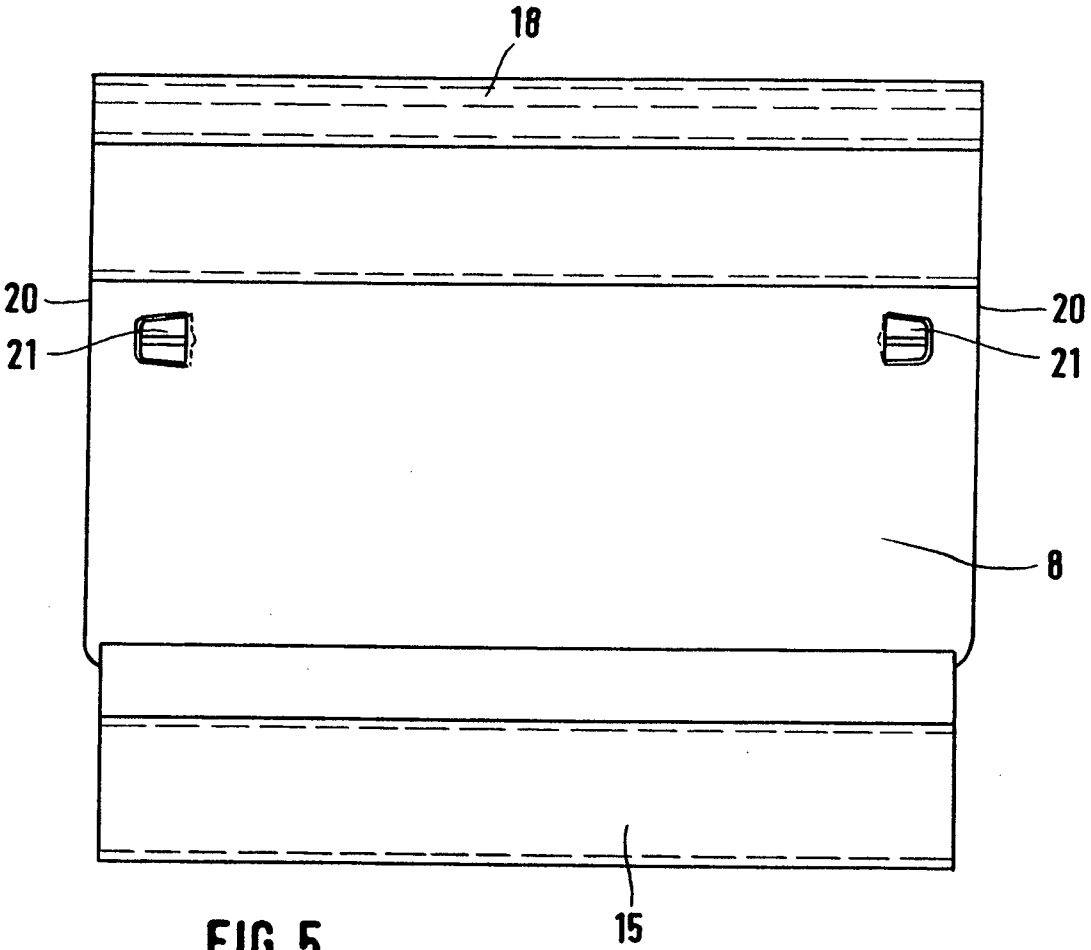
FIG. 5 is a front view of the flap of the stackable transportation container according to FIG. 1.

As illustrated in FIGS. 1, 3 and 5 of the drawing, a single loop 15 extends as an oblong tubular section uninterrupted along the entire lower edge of the flap and, thus, simultaneously forms a stabilizing element in the region of the lower edge of the flap. The upper edge of the flap is stabilized by means of a multiple bent edge 18 which is illustrated in FIGS. 1, 3, 5 and 7.

Figure 7:
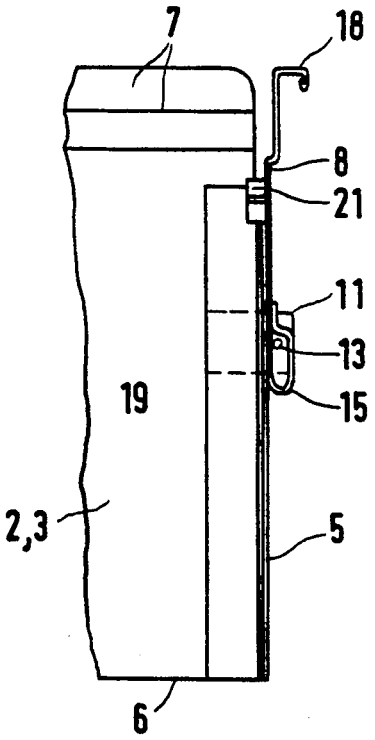
FIG. 7 is a side view of the front portion of a stackable transportation container with front wall and flap.

As can be seen particularly in FIGS. 1, 3 and 7, the loop 15 forming the bearing members 12 of the container extends in the closed position of the flap 8 as a support stop for the flap in front of the upper edge 19 of the front wall 5 which can be seen in FIG. 7 of the drawing.

Tongues 21 are punched out of and bent rearwardly from the plane of the flap 8 near the upright transverse edges 20 of the flap 8. The side walls 2 and 3, on the other hand, have above the front wall 5 a lug 22 each which are bent toward each other. The upper end of each lug 22 can be seen in FIG. 3. However, FIG. 3 also shows that, in the closed position of the flap 8, the tongues 21 can be moved from top toward bottom into a locked engagement with the lugs 22. As a result, the flap 8 is supported in its closed position not only by the loop 15 against the upper edge 19 of the front wall 5, but the flap is additionally supported by the two tongue 21 at the lugs 22 of the side walls 2 and 3.

Figure 4:
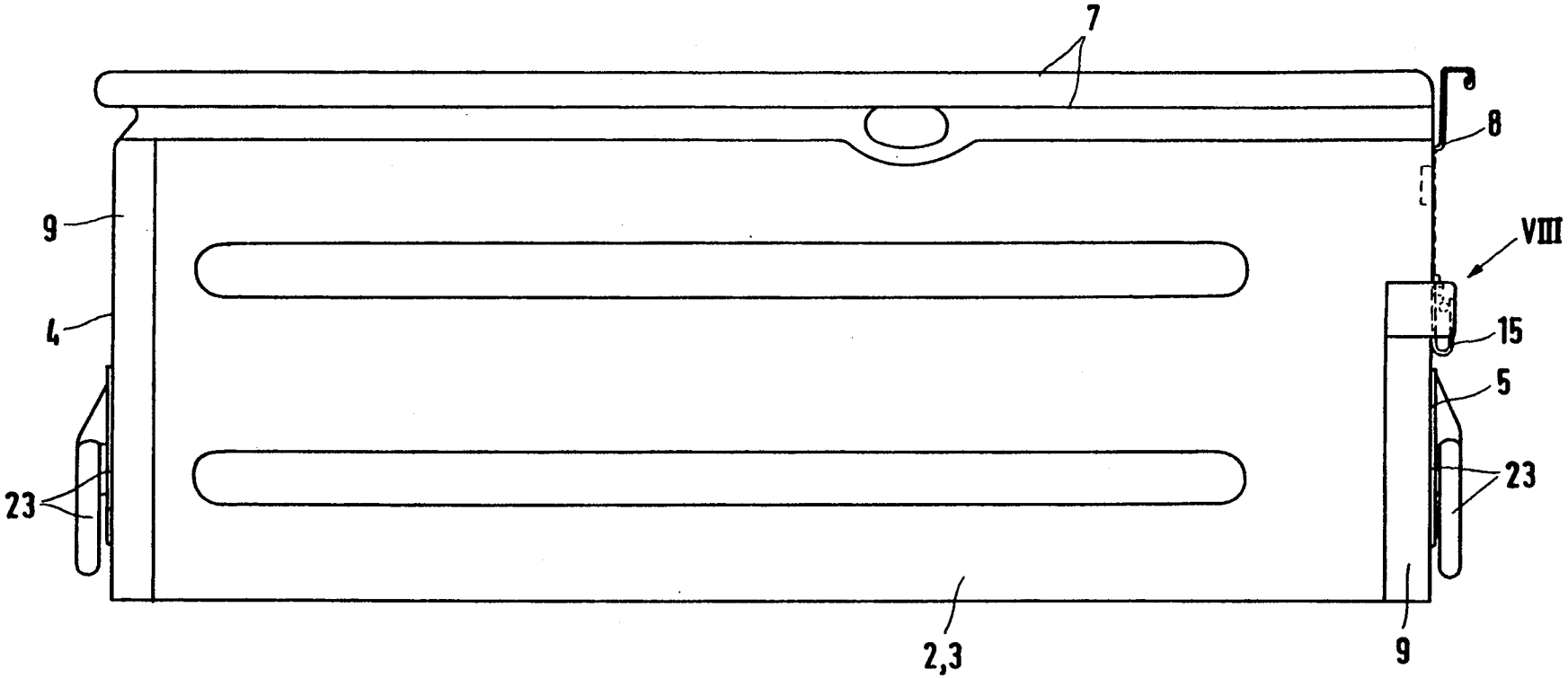
FIG. 4 is a side view of the container of FIG. 1.
Figure 6:
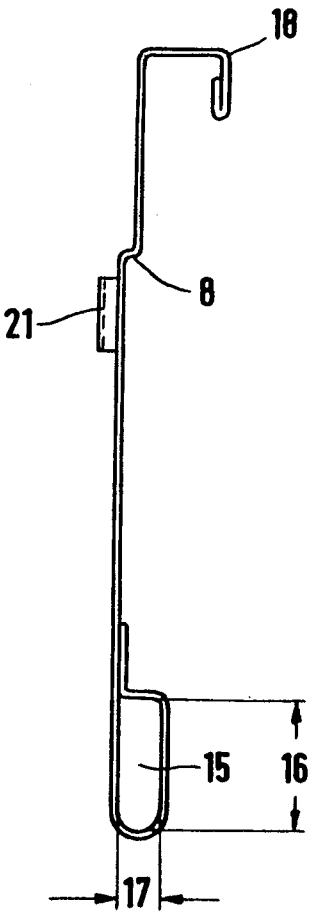
FIG. 6 is a side view of the flap of FIG. 5.

FIGS. 3 and 4 of the drawing show that a drop grip 23 can be provided at the rear wall 4 and at the front wall 5 of the stackable transportation container 1. Moreover, FIG. 1 shows that a transversely extending support rod 24 can be arranged between the side walls 2 and 3 of the stackable transportation container 1 near the stacking edge 7.

The usefulness of the stackable transportation container 1 is increased if the surface thereof is corrosion resistant. For this reason, all components of the container 1 are usually provided with a protective surface coating. This surface coating is provided at least by electric galvanization or hot galvanization.

In order to prevent under any circumstances an undesirable distortion or bending of the flap 8 when the surface coating or galvanization is applied, the surface coating of the flap 8 takes place independently of the surface coating of the remaining stackable transportation container.

In order to obtain a correct support of the flap 8 on the container 1, on the one hand, and to ensure a problemfree surface coating of all components to be assembled, on the other hand, at least one of the support plates 14 supporting a pin 13 is only subsequently fastened to the container corner by rivets 25, as can be seen in FIG. 1 of the drawing. It is important in this regard that, before the connection is effected by means of the rivets 25, the pin 13 mounted on the support plate 14 to be subsequently installed is inserted from the side into the loop 15 which serves as the bearing member 12 on the flap and that only subsequently the connection by means of rivets 25 between the support plate 14 and the respective side wall 3 is effected.

Figure 8:
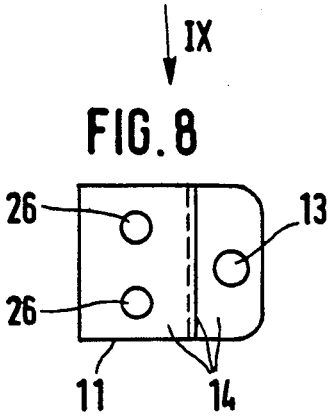
FIG. 8 shows, on a larger scale, the detail of the container indicated by VIII in FIG. 4.
Figure 9:
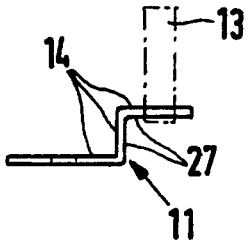
FIG. 9 shows a detail of FIG. 8 seen in the direction of arrow IX.

As shown in FIG. 8, for the purpose of making the rivet connection, the support plate 14 is provided with at least two holes 26 which are to be mounted so as to coincide with corresponding holes in the side wall 3 before the rivets can be inserted to effect the rivet connection 25. A problemfree seat of the support plate 14 on the container corner is ensured by providing each support plate 14 with an approximately Z-shaped portion 27 which engages in a supporting manner in front of the front wall 5 of the container 1, as can be seen in FIGS. 1 and 3.

Of course, it is also possible to mount both bearing members 11 on the container by riveting the support plate 14 to the container 1 only when the flap 8 is also assembled.

On the other hand, one of the bearing members 11 can be connected initially rigidly to the stackable transportation container 1, for example, by means of welding, so that this bearing member is surface coated together with the remaining container. In this case, it is then only necessary to subsequently mount the second bearing member 11 by riveting its support plate 14 to the stackable transportation container 1 when the flap 8 is mounted.

While a specific embodiment of the invention has been shown and described in detail to illustrate the application of the inventive principle, it will be understood that the invention may be embodied otherwise without departing from such principles.

I claim:

1. A stackable transportation container of sheet metal, comprising:

two side walls and a rear wall having upper stacking edges forming an upper opening of the container;

a front wall which is lower than the side walls and the rear wall;

a flap mounted in the area of an upper edge of the front wall, the flat being connected to the container by bearing members on the flap and bearing members on the container, the bearing members on the flap being integrally formed loops and the bearing members on the container being formed by two pins which are directed toward each other, each of the pins being mounted on a support plate connected to a corner of the container; and means for separately connecting at least one of the support plates to an external portion of the container and wherein the loops forming the bearing members on the flap have in a direction parallel to the flap an oblong cross-section with an internal length and an internal width, wherein the internal length corresponds at least to twice the internal width, and wherein the loops, in a closed position of the flap, engage as a support stop in front of the upper edge of the front wall.

2. The container according to claim 1, wherein the loops form an uninterrupted oblong tubular profile extending along the entire width of the flap.

3. The container according to claim 1, further comprising tongues which are cut and bent rearwardly from the flap near transverse edges of the flap, the side walls having above front wall lugs which are bent toward each other, wherein, in the closed position of the flap, the tongues of the flap are inserted in the lugs for a locked engagement.

* * * * *